United States Patent [19]

Yokota

[11] 4,120,154

[45] Oct. 17, 1978

[54] INTERNAL COMBUSTION ENGINE

[75] Inventor: Akira Yokota, Yokosuka, Japan

[73] Assignee: Nissan Motor Company, Limited, Japan

[21] Appl. No.: 674,767

[22] Filed: Apr. 8, 1976

[30] Foreign Application Priority Data

Apr. 22, 1975 [JP] Japan ..... 50-54915[U]

[51] Int. Cl.[2] ..... F01N 3/10; F02B 23/00

[52] U.S. Cl. ..... 60/282; 123/188 GC; 123/193 H

[58] Field of Search ..... 60/272, 282; 123/191 A, 123/193 H, 188 GC

[56] References Cited

U.S. PATENT DOCUMENTS

| | | | |
|---|---|---|---|
| 2,260,656 | 10/1941 | Bell | 60/272 |
| 2,778,352 | 1/1957 | Kimberly | 123/188 GC |
| 3,577,727 | 5/1971 | Warren | 60/282 |
| 3,728,994 | 4/1973 | Bachle | 123/188 GC |
| 3,786,795 | 1/1974 | Kaneko | 60/272 |

FOREIGN PATENT DOCUMENTS

| | | | |
|---|---|---|---|
| 2,323,793 | 11/1974 | Fed. Rep. of Germany | 60/282 |

*Primary Examiner*—Douglas Hart

[57] ABSTRACT

An internal combustion engine having an exhaust port passage which is provided with a port liner is disclosed. To prevent a leak of gas through an aperture formed in the port liner for an exhaust valve stem to extend, a valve guide is provided with means for closing space between the valve stem and a peripheral edge of the aperture.

1 Claim, 5 Drawing Figures

INTERNAL COMBUSTION ENGINE

The present invention relates to an internal combustion engine, more particularly to an internal combustion engine having an exhaust port passage provided with a port liner.

For the purpose of reducing the temperature gradient along each of a plurality of exhaust port passages formed through a cylinder head of an internal combustion engine, it is known to provide a port liner within the exhaust port passage to minimize heat transfer toward the cylinder head through an inner wall defining the exhaust port passage. In a known internal combustion engine, each of the exhaust port passages formed through a cylinder head has therein a dual thin metal walled tubular port liner. An inner metal tubular wall of the port liner extends from an exhaust valve seat to a discharge end of the exhaust port passage at which one of the manifold passages of an exhaust manifold meets with the exhaust port passage, while an outer metal wall of the port liner, which is secured to the inner metal tubular wall to form an insulator layer therebetween, is supported within the exhaust port passage in spaced relation with an inner wall defining the exhaust port passage to reduce the surface area through which heat is transferred from the outer metal wall to the inner wall defining the port passage. The port liner is formed with an aperture having a diameter relatively larger than that of a valve guide receiving bore drilled through the cylinder head. A sleeve-like valve guide is pressed into the bore and a stem of an exhaust valve extends through the aperture of the port liner and the valve guide.

This construction has an insufficiency that because the diameter of the aperture of the port liner is relatively larger than that of the valve guide receiving bore, a portion of exhaust gas flowing along the inner metal tubular wall may leak into a space between the outer metal wall and the inner wall defining the exhaust port passage through the aperture, is cooled by contact with the inner wall which is cooled by cooling liquid flowing through the cylinder head. Because the space has one end opening to the associated manifold passage, the low temperature gas is allowed to enter the manifold passage, thus accelerating reduction of temperature of the exhaust gas within the manifold passage. There is a possibility that a gasket, disposed between the cylinder head and an attachment flange of the manifold passage, is used to close the space at its end opening to the manifold passage. However this requires very precise alignment of the manifold passage with the discharge end of the exhaust port passage and is not acceptable as a measure to eliminate the above mentioned problem encountered in the known internal combustion engine.

Accordingly a main object of the present invention is to prevent a leak of a portion of exhaust gas through a port liner toward an inner wall defining an exhaust port passage.

Another object of the present invention is to provide a simple arrangement to close a space between a valve stem and a peripheral edge of an aperture of a port liner.

These objects, features and advantages of the present invention will become clear from the following description in connection with the accompanying drawings, in which.

Figure 1:
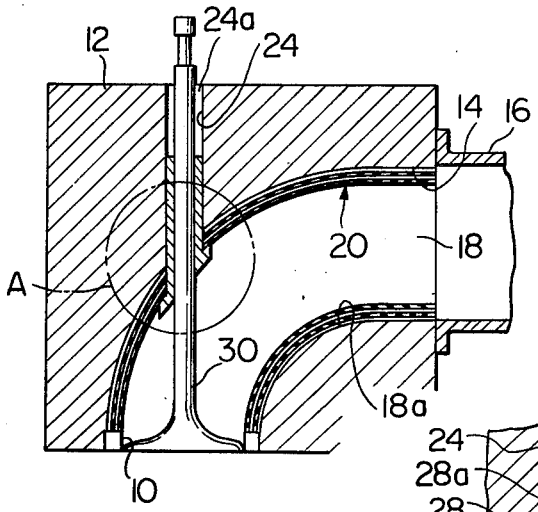
FIG. 1 is a diagrammatic sectional view of a part of an internal combustion engine, illustrating an arrangement of a port liner and a valve guide for an exhaust valve according to the present invention.
Figure 2:
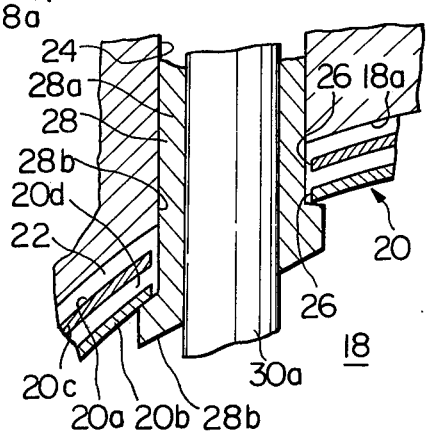
FIG. 2 is an enlarged view of a portion surrounded by a circle A in FIG. 1.

Referring to the accompanying drawings, and more particularly to FIGS. 1 and 2, a first embodiment of an internal combustion engine according to the present invention is shown, the internal combustion engine having a plurality of exhaust intake openings, only one being shown at 10, corresponding in number to a plurality of cylinders (not shown) of the engine. The engine includes a cylinder head 12. The cylinder head 12 has a plurality of exhaust discharge openings, only one being shown at 14, which connect with respective manifold passages, only one being shown at 16, of an exhaust manifold. Formed through the cylinder head 12 are a plurality of exhaust port passages, corresponding in number to the plurality of exhaust discharge openings. Each of the plurality of exhaust port passages, only one being shown at 18, extends from the exhaust discharge opening 14 to at least one of the plurality of exhaust ports 10. Each of the port passage 18 is defined by a wall **18*a* on the cylinder head 12. A dual-walled port liner 20 is mounted in the exhaust port passage 18 and spaced from the wall 18*a* such as by spacers (not shown) to form a space 22 between the wall 18*a* and an exterior surface of the port liner 20*a*. The dual-walled port liner 20 is constructed of a inner metal layer 20*b*, an outer metal layer 20*c* and an air layer 20*d* between the inner and outer metal layers 20*b* and 20*c***.

The cylinder head 12 is formed with a valve guide receiving bore 24 having one end **24*a* opening outward of the cylinder head and the other end 24*b* opening to the exhaust port passage 18 and the port liner 20 is formed with an aperture, which is defined by an edge 26 of the port liner 20 and positioned directly below the bore 24. A valve guide 28 has a sleeve portion 28*a* and flange portion 28*b* formed at lower end of the sleeve portion 28*a*. The flange portion 28*b* contacts with the inner metal layer 20*b* of the port liner 20 at an area around the edge 26 to close the aperture when the valve guide 28 is in a position illustrated in FIG. 1 or 2, of an exhaust valve 30 thus sealing between a valve stem 30*a* and the edge 26** of the aperture.

In the illustrated position the sleeve portion **28*a* of the valve guide 28 is pressed into the bore 24 and extends through the aperture of the port liner 20 and the flange portion 28*b* thereof contacts with the interior surface of the inner metal layer 20*b*. In assembly the sleeve portion 28*a* is inserted into the bore 24 through the aperture of the port liner 20 and subsequently pressed into the bore upwardly as viewed in FIGS. 1 and 2 until the flange portion 28*b* contacts with the interior surface of the inner metal layer 20*b***.

Figure 3:
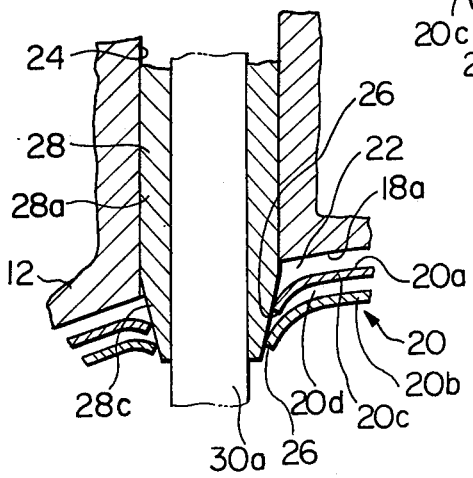
FIG. 3 is a similar view to FIG. 2, illustrating a second embodiment of the present invention.

The second embodiment illustrated in FIG. 3, in which similar parts to those shown in FIGS. 1 and 2 are designated by the same reference numerals, is different from the first embodiment in that the diameter of an aperture of a port liner 20 is smaller than that of a valve guide receiving bore 24 to receive a sleeve portion **28*a* of a valve guide 28 and the valve guide 28 has formed on the sleeve portion 28*a* a tapered portion 28*c* contacting with the port liner 20 at an area around the edge 26 defining the aperture to substantially close the aperture. In assembly the tapered portion 28***c* is inserted into the bore 24 from the upper end 24*a* thereof (see FIG. 1) and the sleeve portion 28*a* is pressed deeply into the bore 24 downwardly, as viewed in FIG. 3, until the tapered portion 28*c* is rammed into the aperture.

Figure 4:
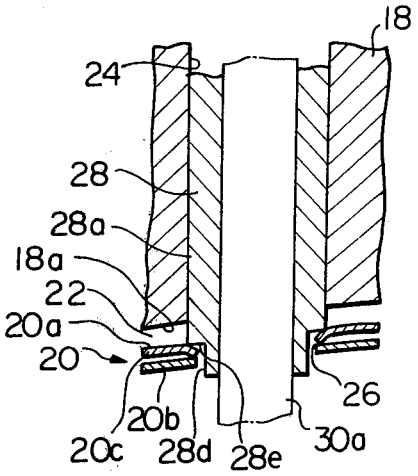
FIG. 4 is a similar view to FIG. 2, illustrating a third embodiment of the present invention.

The third embodiment illustrated in FIG. 4 is basically similar to the second embodiment so that similar parts to those shown in FIG. 3 are designated by the same reference numerals. The only difference is in that a reduced diameter portion 28*d* has replaced the tapered portion 28*c* in this embodiment. The reduced diameter portion 28*d* extends into an aperture, which is smaller in diameter than a valve guide receiving bore 20 for receiving a sleeve portion 28*a*, with an annular shoulder 28*e* interconnecting the reduced diameter portion 28*d* and the sleeve portion 28*a* contacting with the exterior surface 20*a* of an outer metal layer 20*c* of a port liner 20 to close the aperture. In assembly the reduced diameter portion 28*d* is inserted into the bore 20 from the upper end 24*a* thereof (see FIG. 1) and the sleeve portion 28*a* is pressed deeply into the bore 24 downwardly until the annular shoulder 28*e* deforms the outer metal layer 20*c* so that it engages an inner metal layer 20*b* as shown in FIG. 4.

In the second and third embodiments the bore is drilled and the aperture is formed with a tool by inserting the tool to the port liner through the drilled bore.

Figure 5:
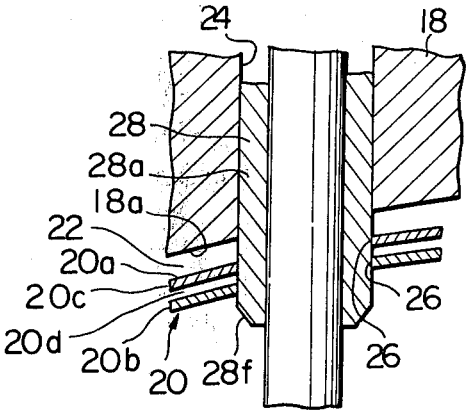
FIG. 5 is a similar view to FIG. 2, illustrating a fourth embodiment of the present invention.

The fourth embodiment illustrated in FIG. 5, in which similar parts to those shown in FIG. 4 are designated by the same reference numerals, is different from the third embodiment in that a bore 24 and an aperture are formed to have the same diameter and a sleeve portion 28*a* is inserted into the aperture and fit therein to close the aperture. A tapered portion 28*f* formed on one end of the sleeve portion is to facilitate insertion of the sleeve portion 28*a* into the aperture when in assembly.

It will be noted from the preceding that an aperture through which exhaust gas might leak is closed with simple means.

What is claimed is:

1. In an exhaust system for an internal combustion engine:

an exhaust manifold having at least one manifold passage;

a cylinder head having at least one exhaust discharge opening at which said cylinder head is connected to said manifold passage, at least one exhaust intake opening and at least one exhaust port bore extending from said exhaust discharge opening to said exhaust intake opening, said cylinder head having wall means defining said exhaust port bore and a valve guide receiving bore having one end opening outward of said cylinder head and an opposite end opening to said exhaust port bore;

a double-walled port liner formed by an inner metal tube and an outer metal tube, said outer metal tube surrounding said inner metal tube and cooperating with same to form a space therebetween, said inner metal tube defining an exhaust flow passage, said double-walled port liner being fixedly mounted within said exhaust port bore so that a second space is formed between said outer metal tube and said wall means, said first mentioned space surrounding substantially all of the outer surfaces of said inner metal tube, being closed at an area adjacent said exhaust intake opening, and being open to said manifold passage at an area adjacent said exhaust discharge opening, said second space surrounding substantially all of the outer surfaces of said outer metal tube, being closed at the area adjacent said exhaust intake opening, and being open to said manifold passage at the area adjacent said exhaust discharge opening.

a valve guide having a sleeve portion fixedly received in said valve guide receiving bore, said valve guide having a tapered end portion extending into said exhaust flow passage through said outer and inner metal tubes having seal portions, respectively, which are bent toward said exhaust flow passage to contact said tapered end portion to seal between said tapered end portion and said outer and inner metal tubes; and an exhaust valve having a stem slidably received in said valve guide.

* * * * *